US007096997B2

(12) United States Patent
Appleby et al.

(10) Patent No.: US 7,096,997 B2
(45) Date of Patent: Aug. 29, 2006

(54) TRACKSIDE FRICTION MANAGEMENT DIGITAL CONTROL SYSTEM

(75) Inventors: Glen Appleby, St-Lazare (CA); Jacques Lamond, Pierrefonds (CA); Kostas Papazoglou, Dollard-des-Ormeaux (CA)

(73) Assignee: Portec, Rail Products Ltd., Lachine (CA)

( * ) Notice: Subject to any disclaimer, the term of this patent is extended or adjusted under 35 U.S.C. 154(b) by 488 days.

(21) Appl. No.: 10/458,604

(22) Filed: Jun. 10, 2003

(65) Prior Publication Data

US 2004/0011593 A1 Jan. 22, 2004

Related U.S. Application Data

(60) Provisional application No. 60/388,456, filed on Jun. 13, 2002.

(51) Int. Cl.
*B61K 3/00* (2006.01)

(52) U.S. Cl. ..... 184/3.1; 222/14

(58) Field of Classification Search ..... 184/3.1; 222/394, 54, 14; 104/279; 105/96
See application file for complete search history.

(56) References Cited

U.S. PATENT DOCUMENTS

| | | | | |
|---|---|---|---|---|
| 2,349,259 | A | 5/1944 | Fuller | |
| 2,401,303 | A | 6/1946 | Huber | |
| 2,486,600 | A | 11/1949 | Huber et al. | |
| 2,643,738 | A | 6/1953 | Magnus | |
| 3,838,646 | A | 10/1974 | Smith et al. | |
| 4,214,647 | A | 7/1980 | Lutts | |
| 4,334,596 | A | 6/1982 | Lounsberry, Jr. | |
| 4,368,803 | A | 1/1983 | Dombroski et al. | |
| 4,520,901 | A | 6/1985 | Borup et al. | |
| 4,856,617 | A | 8/1989 | Lounsberry, III et al. | |
| 5,641,037 | A | 6/1997 | Wise et al. | |
| 5,842,543 | A | 12/1998 | Naito et al. | |
| 6,076,637 | A | 6/2000 | Kumar | |
| 6,199,661 | B1 | 3/2001 | Kumar | |
| 6,446,754 | B1 * | 9/2002 | Kostelny-Vogts et al. | 184/3.1 |
| 6,464,039 | B1 | 10/2002 | Urmson et al. | |
| 6,585,085 | B1 * | 7/2003 | Kumar | 184/3.2 |
| 2002/0056592 | A1 | 5/2002 | Arens et al. | |
| 2002/0157901 | A1 | 10/2002 | Kast et al. | |
| 2003/0010571 | A1 | 1/2003 | Kostelny-Vogts et al. | |
| 2004/0031647 | A1 * | 2/2004 | Leslie et al. | 184/3.1 |

FOREIGN PATENT DOCUMENTS

| | | | |
|---|---|---|---|
| GB | 2267938 | A | 12/1993 |
| WO | WO 01/92081 | A1 | 12/2001 |

* cited by examiner

*Primary Examiner*—David Fenstermacher
(74) *Attorney, Agent, or Firm*—Robert P. Lenart, Esq.; Pietragallo, Bosick & Gordon LLP

(57) ABSTRACT

An apparatus for applying friction modifying materials to a railroad track includes an input for receiving a signal representative of the passage of railroad vehicle wheels, and means for applying friction modifying material to the railroad track for a user defined, field programmable time duration when the number of wheels reaches the user defined, field programmable, activation level. A method of applying friction modifying materials to a railroad track performed by the apparatus is also provided.

17 Claims, 2 Drawing Sheets

TRACKSIDE FRICTION MANAGEMENT DIGITAL CONTROL SYSTEM

CROSS-REFERENCE TO RELATED APPLICATION

This application claims the benefit of U.S. Provisional Patent Application Ser. No. 60/388,456, filed Jun. 13, 2002, the disclosure of which is hereby incorporated by reference.

FIELD OF THE INVENTION

This invention relates to methods and apparatus for applying lubricants and/or other friction modifying materials to the rails of railroad tracks, and more specifically, to programmable methods and apparatus, which supply lubricants and/or friction modifying materials in response to user defined criteria.

BACKGROUND OF THE INVENTION

Lubricants and/or other friction modifying materials are commonly applied to the rails of railroad tracks. The application of lubricant to the rails has been found to reduce the frictional wear on the railhead and the noise produced by the flanges of the wheels on the railhead. Lubricating devices that are positioned next to the rails of a railroad track and activated by the passage of the wheels of the railroad vehicle to discharge a lubricant onto the railhead are well-known. Many of the known lubricating devices include a lubricant supply tank located in the ground near the rail, one or more lubricant distributing elements positioned on one side of the rail, a pump in the supply tank for conveying lubricant through one or more pipes to the lubricant distributing elements positioned on one side of the rail, and an actuator element located along the length of the rail. The actuator element is suitably connected to the pump and operates the pump in response to the passage of the wheels of the railroad vehicle over the actuator element.

In some of the present-day lubricating devices, the connection between the actuator element and the pump in the supply tank is mechanical, involving an elongated rotatable drive rod with attendant joints, springs, bearings, etc. However, over time, these mechanical elements deteriorate due to wear and tear. Additionally, in order to function, these lubricating devices must be located above the ground next to the rail. The location of these devices generally results in damage to the devices particularly when the railroad vehicle derails or when rail equipment is dragged along the tracks. From this, it can easily be appreciated that a lubricating device using a mechanical connection is sometimes undesirable.

Further known lubricating devices include a connection between the actuator element and the pump in the supply tank that consists of either a single hydraulic fluid line or a recirculating fluid loop in which hydraulic fluid, such as light oil is caused to flow by the activation of the actuator element.

Electric lubrication systems can be used to supply lubricant to railroad tracks. In one known electric lubricating system, a fixed, standing cabinet is divided into two compartments. A lower compartment houses two containers of grease, one in use and the other in reserve. The upper compartment houses the electric motor driven pump and an electronic control box. The pump is arranged so that the pump inlet tube projects downward through the cabinet partition into the grease container below. Space is provided for the mounting of batteries and any additional electric regulator equipment for a DC version operated using batteries and/or solar panels. Initiation of pump operation is triggered from a vibration sensor mounted on a track sleeper and the pump action causes grease to be pumped via flexible hoses to grease distribution units adjacent the rail.

In the arrangements described above, the distribution of grease is triggered by the passing of a train, either by the mechanical depression of pumps by successive passing of wheels in the case of a mechanical lubricator or by the triggering of a sensor in the case of an electrical lubricator. Both systems are relatively inflexible and not adapted to all types and densities of traffic. For example, it might be the case that at one location, a mechanical lubricator might apply too much grease if a train having a large number of cars were to pass. On the other hand, in the case of a sensor-triggered lubricator which would not recognize the length of a passing train, too little grease might be applied.

There is, therefore, a need for an improved lubricating and/or friction modifying system, so that desired friction characteristics can be maintained.

SUMMARY OF THE INVENTION

This invention provides an apparatus for applying friction modifying materials to a railroad track that includes an input for receiving a signal representative of the passage of railroad vehicle wheels, and means for applying friction modifying material to the railroad track for a user defined, field programmable time duration when the number of wheels reaches the user defined, field programmable, activation level.

The apparatus can further include means for detecting the direction of train travel, and means for adjusting the amount of friction modifying material in response to the detected direction of train travel. More particularly, the time for which friction modifying material is applied can be different for each direction of train travel, or the friction modifying material can be applied only for trains traveling in the single direction.

The apparatus can further comprise means for sensing rain and/or humidity, and means for adjusting the amount or type of friction modifying material applied to the railroad track in response to the rain and/or humidity.

In another aspect, the invention encompasses a method of applying friction modifying materials to a railroad track, the method comprising the steps of sensing the passage of railroad vehicle wheels, and applying friction modifying material to the railroad track for a user defined, field programmable time duration when the number of wheels reaches the user defined, field programmable, activation level.

The method can further comprise the steps of detecting the direction of train travel, and adjusting the amount of friction modifying material applied to the railroad track in response to the detected direction of train travel.

The time for which friction modifying material is applied can be different for each direction of train travel. Various parameters such as the run time of the motor and the total wheel count can be monitored and stored.

The method can further comprise the steps of sensing rain and/or humidity, and adjusting the amount or type of friction modifying material in response to the rain and/or humidity.

DETAILED DESCRIPTION OF THE INVENTION

This invention provides an apparatus and method for applying friction-modifying materials to the rails of a railroad. For the purposes of this description, friction modifying materials includes lubricants and other materials that are used to adjust the level of friction between the rails and the wheels of railroad vehicles.

Figure 1:
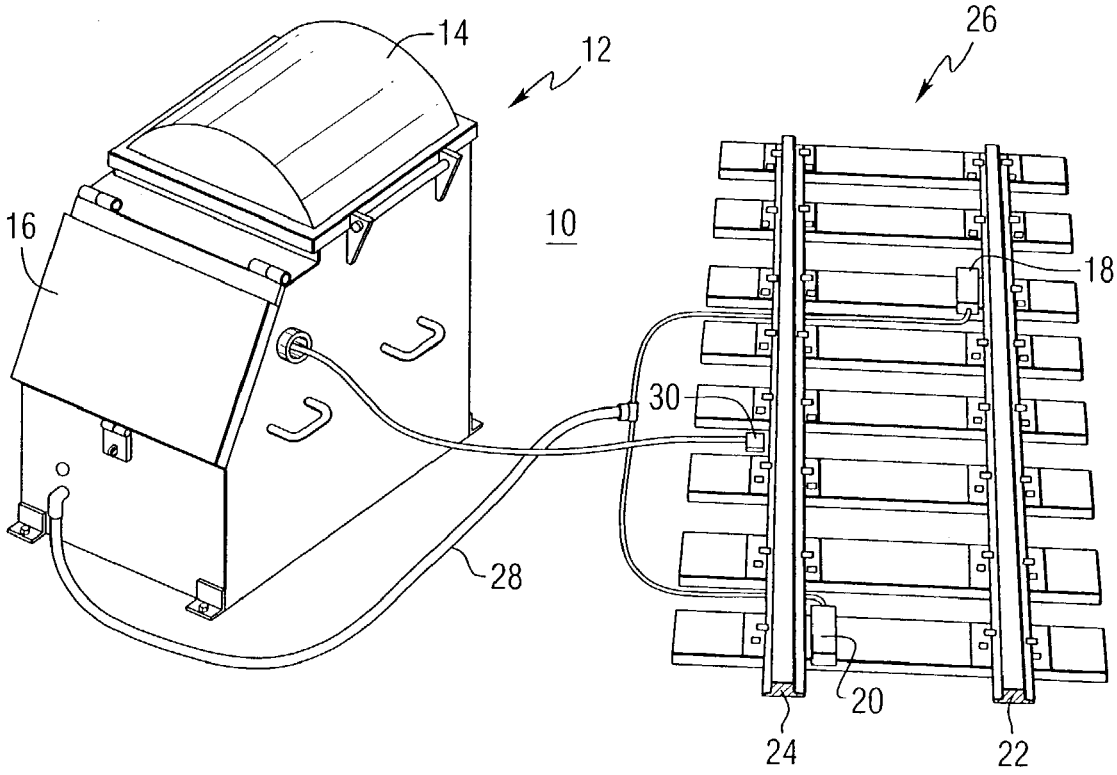
FIG. 1 is a pictorial representation of a railroad track lubricating system constructed in accordance with the present invention and located adjacent to a rail of a railroad track.

Referring to the drawings, FIG. 1 is a pictorial representation of a friction management system 10 constructed in accordance with the invention. The system includes an enclosure 12 including a first compartment, or reservoir 14, for containing friction modifying material, and a second compartment 16 containing a control unit and a pump. One or more friction modifying material applicators 18, 20 are positioned in spaced apart fashion adjacent to the rails 22, 24 of a railroad 26 so as to supply friction modifying material to rails. The applicators are connected to the enclosure by conduits 28 that conduct the friction modifying material from the enclosure to the applicators. At least one wheel sensor 30 is positioned to detect the passage of wheel of a rail vehicle and sends a signal to a control unit in the enclosure. The applicators and wheel sensor can be commercially available products.

The control unit housed in compartment 16 of the enclosure includes a processor that controls the operation of a pump that delivers the friction modifying materials to the applicators. The processor is responsive to inputs supplied by a user. Many of the components of friction control system can be buried in the ground in order to avoid possible damage to these components upon derailment of the vehicle or upon other physical impacts from equipment used in railroads.

Compartment 14 retains friction modifying material that is to be delivered to applicators 18, 20, and is structured so as to keep friction modifying material completely separate from the other components of the enclosure and to prevent lubricant from contaminating the components located in the adjacent compartment 16. Compartment 16 is designed to remain free of friction modifying material and contains a motor pump assembly and control unit, in addition to other components that are necessary for the complete operation of friction control system 10.

Figure 2:
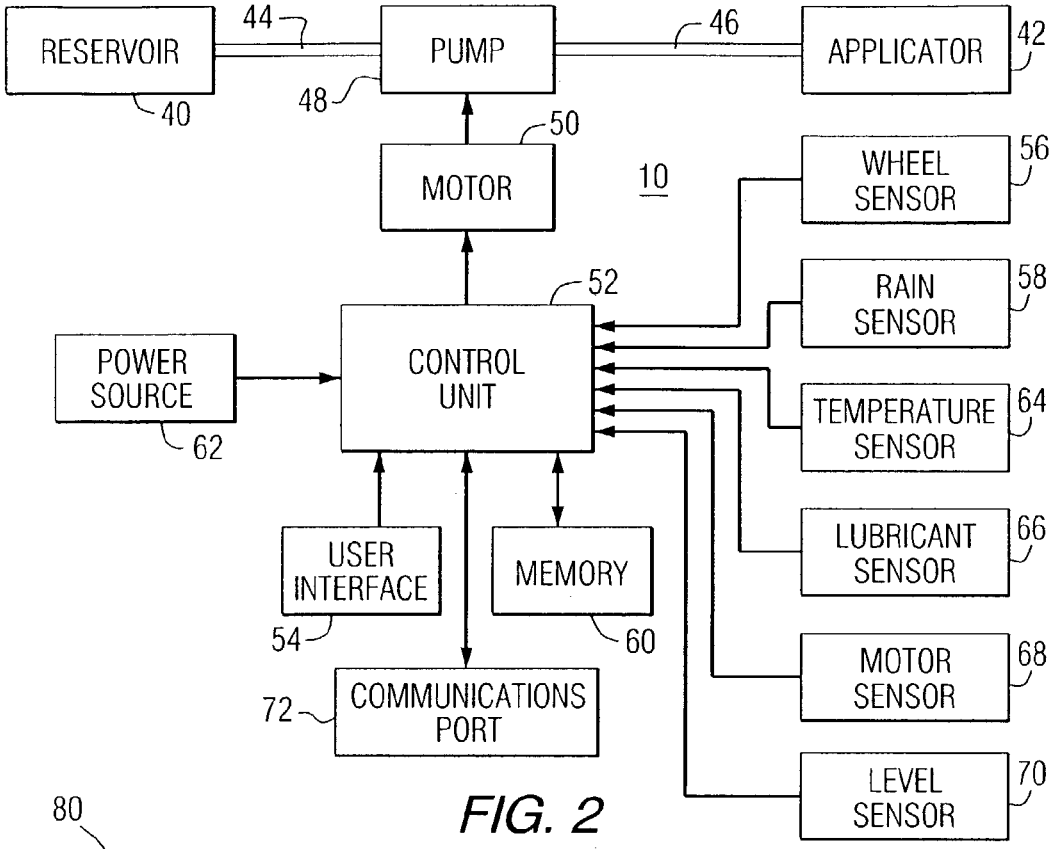
FIG. 2 is a functional block diagram of the system of FIG. 1.

FIG. 2 is a functional block diagram of a friction management system 10 constructed in accordance with the invention. The system includes a reservoir 40 for containing friction modifying material. The reservoir is connected to one or more applicators 42 by one or more conduits 44, 46. A pump 48 is provided to pump friction modifying material from the reservoir to the applicators. The pump is driven by a motor 50, which operates in response to a control signal from a control unit 52. The control unit includes a processor that can be mounted on a custom printed circuit board and adapted to interface with various input and output devices. The processor is field programmed to control the operation of the motor in accordance with selected parameters. A user interface 54 is provided to set the parameters to be used by the processor. The processor receives inputs from one or more wheel sensors 56 and a rain or humidity sensor 58. A memory 60 is provided to store various data relating the operation of the system. A power source 62, which can include for example a battery, battery charger, battery condition indicator, and a solar panel, is used to power the system. The control unit can also receive inputs from one or more other sensors, including a temperature sensor 64, a lubricant quantity sensor 66, a motor running sensor 68, and/or a lubricant level sensor 70. A pump motor 50 is operated by the control unit to pump friction modifying material to the applicators in accordance with various parameters provided by an operator. A communications port 72 is provided so that the control unit can interface with various devices, such as personal computers, personal digital assistants, or global positioning systems, using various interface technologies, such as radio frequency signals or infrared signals.

In operation, the wheels of passing trains are counted. When the number of wheels reaches a user defined, field programmable, activation level, a relay is activated to supply power to the pump motor for a user defined, field programmable length of time. The direction of train travel can be detected using a uni-directional wheel sensor or multiple bi-directional wheel sensors. The activation sequence and pump operating time can be different for train travel in different directions. The total run time of the motor and the total wheel count can be monitored and stored in the memory. A single test button can be used to test the functioning of all inputs, outputs and internal circuitry. The rain/humidity sensor can signal the control unit to automatically change operating parameters to user defined, field programmable levels. A resettable wheel counter can also be provided to keep track of the number of wheels counted after a user defined start time.

Inputs from the various sensors can be used to automatically adjust the operating parameters. For example, the application of friction modifying materials can be inhibited during rain. After a long period of rain, the amount of applied friction modifying materials can be increased to rapidly achieve the desired rail friction characteristics.

In one embodiment of the invention, the control unit, also called a digital control box (DCB), is housed in compartment 16 and includes a liquid crystal display, a toggle switch and several push button switches, each mounted under a membrane that completely covers the top surface of the switches.

Figure 3:
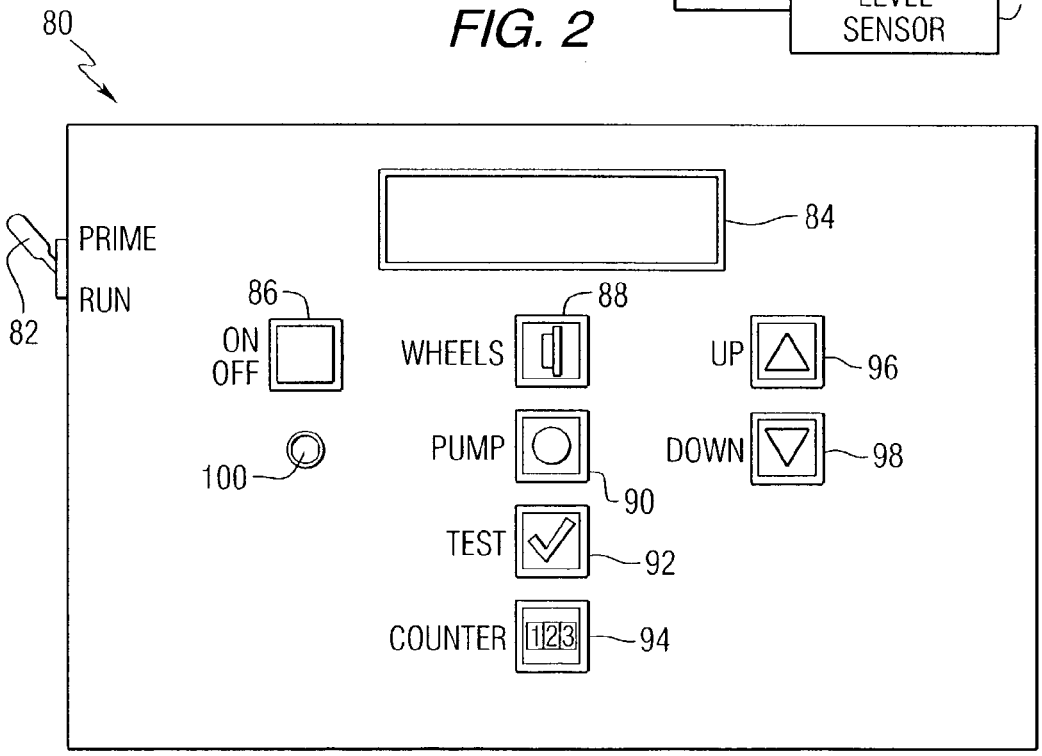
FIG. 3 is a front view of a user interface panel in the system of FIG. 1.

FIG. 3 is a front view of a user interface, or control panel 80 of the control unit. The user interface panel includes a toggle switch 82 that alternatively connects the power source to the control unit or a pump motor. The toggle switch 82 has two positions. When the switch is in the prime position, the pump motor will run continuously. This setting is used to fill the hoses with friction modifying material or to test the pump. When the switch is in the normal position, pump power is supplied by the control unit. The control panel includes the display 84, which can be a liquid crystal display, an ON/OFF push button switch 86, several push button input switches 88, 90, 92, 94, 96 and 98, and a three-color light emitting diode indicator 100.

Pressing the ON/OFF button 86 will cause the light emitting diode 100 to change to green, and the display will cycle through a sequence, first displaying a wheel count and the number of wheels remaining until the next application of friction modifying material. Then it will display the current setting for the duration of a pump operating sequence and the current setting for the activation frequency, for example the number of wheels that must pass before the pump is activated.

Pressing the UP or DOWN arrow keys, 96 or 98, will cause the display to repeat the sequence. Pressing the WHEELS button 88 will cause the display to show the pump frequency in number of wheels. When this display is active, the UP or DOWN arrow keys can be used to change the number of wheels that must be detected before additional friction modifying material is pumped to the applicator.

After a predetermined time, the display will revert to its initial state. Pressing the PUMP button 90 causes the display to show the pump duration in seconds. The UP and DOWN arrows can be used to adjust the pump duration, for example in 0.05 sec increments.

Pressing the test button 92 will cause the display to show the pump duration in seconds and the frequency in number of wheels. Then the wheel count will count down to zero. Once the wheel count reaches zero, the LED will turn red for the amount of time set for the duration, and the pump motor will run for that amount of time. Then the display will turn off.

When the COUNTER button 94 is pressed, the display will show the total wheel count for a predetermined time period and will then display to the total pump time, that is, the accumulated run time of the motor.

When there is no train wheel passing the unit, the unit is in the wait mode, with the display off and the green LED on. When a wheel passes, the LED flashes yellow for each wheel detected. When the programmed number of wheels is reached, the LED turns red and the motor is activated for the programmed amount of time to pump friction modifying material to the applicators.

If the LED flashes green continuously when the ON/OFF button is pushed, then there is a low voltage condition. If the voltage is above 11.5 volts, the LCD will still function and programming changes can be made but the control box will not count the wheels. If the voltage is restored above 12 volts, the controller will resume normal operation and continue from where it stopped.

A programming example can now be described. Assume that the current settings are: Duration=0.25 seconds and Frequency=21 wheels, and the desired settings are: Duration=0.35 seconds and Frequency=230 wheels. First ensure that the toggle switch is in the normal position. Press the ON/OFF button to turn the digital control box on. Next press the WHEELS button, then press and hold the UP arrow button. After 2 seconds, the count will start to increase quickly. It will take about 12 seconds to reach 230. As the desired value is approached, release the button and then either increment or decrement the value using single pushes of the UP or DOWN arrows keys. To change the duration, simply push the PUMP button, then the UP arrow key twice.

To verify that the settings stored in memory are correct, press the ON/OFF button to turn the control box off, then press the ON/OFF button again to turn the unit on and watch the display. The values can also be checked by pressing the UP arrow or the DOWN arrow key to replay the initial display sequence as previously described.

The control unit contains a processor that can be programmed to automatically adjust the amount of friction modifying materials that are applied to the rails, as well as the timing of the application of the materials. The wheel sensor can be a uni-directional sensor that provides an indication of the direction of travel of a passing train. Alternatively multiple bi-directional wheel sensors can be used to detect the direction of travel. The control unit can control the pump so that different frequency and duration parameters can be used to control the pump, depending upon the direction of travel. For example, the system might apply friction modifying material when trains are traveling in one direction, but not apply it if the trains are traveling in the opposite direction.

When operated in conjunction with the rain and/or humidity sensor the control unit can be programmed to rapidly return the rails to the desired friction level following a rain or high humidity event. By using the interface panel buttons or though the communications port, the user can enter a relative value for how quickly the control unit should adapt to the set parameters. For example, if the user has selected a fast return, then the output can be tripled and the output would then be decremented until the original value is obtained.

The control unit, when operated in conjunction with lubricant level sensing, will automatically shut down the system to prevent pump damage from dry running and will return to normal operation after refilling the reservoir to a predetermined level.

The communications port allows complete field reprogramming and updating of a master program inside the microprocessor. The communications port also allows for direct interfacing of the control unit with either a laptop computer or hand held device to update and monitor the system parameters. The communication port has the added advantage of being capable of interfacing to infrared devices, radio frequency devices, and GPS devices.

In current existing systems the adjustability is not sufficient to account for all of the various configurations of railways in operation. The existing systems are only capable of a few discrete adjustments for relative increase or decrease of the output. The control unit of this invention is essentially infinitely field programmable to allow for precise and exact control of the output for all railways and their configurations. Field reprogramming can be accomplished using the communications port or the button switches on the interface panel.

The control unit is capable of changing the lubrication sensing and operating parameters, with the uni-directional sensor, with software in the field rather than using hardware.

In addition to the apparatus described above, this invention also encompasses a method of applying friction modifying materials to a railroad track performed by the apparatus. The method includes the steps of sensing the passage of railroad vehicle wheels, and applying friction modifying material to the railroad track for a user defined, field programmable time duration when the number of wheels reaches the user defined, field programmable, activation level.

The method can further comprise the steps of detecting the direction of train travel, and adjusting the amount of friction modifying material applied to the railroad track in response to the detected direction of train travel.

The time for which friction modifying material is applied can be different for each direction of train travel. Various parameters such as the run time of the motor and the total wheel count can be monitored and stored.

The method can further comprise the steps of sensing rain and/or humidity, and adjusting the amount or type of friction modifying material in response to the rain and/or humidity.

While particular embodiments of the invention have been described in detail for the purposes of illustration, it will be evident to those skilled in the art that numerous changes may be made to the disclosed embodiments without departing from scope of the invention as defined in the appended claims.

We claim:

1. An apparatus for applying friction modifying materials to a railroad track, the apparatus comprising:

an input for receiving a signal representative of the passage of railroad vehicle wheels; and means for applying friction modifying material to the railroad track for a user defined, field programmable time duration when the number of wheels reaches the user defined, field programmable, activation level.

2. The apparatus of claim 1, further comprising:

means for detecting the direction of train travel; and means for adjusting the amount of friction modifying material in response to the detected direction of train travel.

3. The apparatus of claim 2, wherein the time for which friction modifying material is applied is different for each direction of train travel.

4. The apparatus of claim 1, wherein the means for applying friction modifying material to the railroad track comprises:

a reservoir for containing the friction modifying material;

an applicator;

a pump;

conduit connecting the reservoir to the pump and the applicator;

a motor for driving the pump; and a control unit for operating the motor.

5. The apparatus of claim 4, further comprising:

means for monitoring run time of the motor; and means for storing the total run time of the motor.

6. The apparatus of claim 1, further comprising:

means for storing the total number of wheel counts.

7. The apparatus of claim 1, further comprising:

means for sensing rain and/or humidity; and means for adjusting the amount or type of friction modifying material applied to the railroad track in response to the rain and/or humidity.

8. A method of applying friction modifying materials to a railroad track, the method comprising the steps of:

sensing the passage of railroad vehicle wheels; and applying friction modifying material to the railroad track for a user defined, field programmable time duration when the number of wheels reaches the user defined, field programmable, activation level.

9. The method of claim 8, further comprising the steps of:

detecting the direction of train travel; and adjusting the amount of friction modifying material applied to the railroad track in response to the detected direction of train travel.

10. The method of claim 9, wherein the time for which friction modifying material is applied is field programmed differently for each direction of train travel.

11. The method of claim 8, further comprising the step of:

storing a total number of wheel counts in a memory.

12. The method of claim 8, further comprising the steps of:

monitoring run time of a motor; and storing the total run time of the motor in a memory.

13. The method of claim 8, further comprising the steps of:

sensing rain and/or humidity; and adjusting the amount or type of friction modifying material in response to the rain and/or humidity.

14. The method of claim 13, wherein the step of adjusting the amount or type of friction modifying material in response to the rain and/or humidity, comprises the step of:

changing the amount of friction modifying material applied to railroad track in successive applications of friction modifying material in response to a parameter entered by a user.

15. An apparatus for applying friction modifying materials to railroad track comprising:

a lubricant supply tank;

a pump for pumping lubricant from the supply tank to an applicator;

a wheel sensor for detecting the passing of wheels of a railroad vehicle; and a field programmable control unit for operating the pump in accordance with the number of wheels sensed by the wheel sensor.

16. The apparatus of claim 15, wherein the control unit comprises:

a processor;

a display for displaying information input to and produced by the processor; and means for inputting wheel number and pump duration data to the processor.

17. The apparatus of claim 15, further comprising:

a sensor for sensing rain and/or humidity.

* * * * *